United States Patent [19]

Partlo

[11] Patent Number: 4,889,334

[45] Date of Patent: Dec. 26, 1989

[54] DEVICE FOR SAFELY SECURING BOARDS FOR MARTIAL ARTS ACTIVITIES

[76] Inventor: Loren G. Partlo, 3408 Shaffer, Coleman, Mich. 48618

[21] Appl. No.: 113,498

[22] Filed: Oct. 28, 1987

[51] Int. Cl.[4] ..... A63B 69/00

[52] U.S. Cl. ..... 272/76

[58] Field of Search ..... 272/76, 77, 78, 93; 273/55 R, 55 A, 382; 248/316.5

[56] References Cited

U.S. PATENT DOCUMENTS

| | | | |
|---|---|---|---|
| 1,116,091 | 11/1914 | McDonald | 272/78 |
| 3,883,135 | 5/1975 | Milliken | 272/76 |
| 4,093,212 | 6/1978 | Jacques | 272/76 |
| 4,171,803 | 10/1979 | Smith | 272/76 |
| 4,491,316 | 1/1985 | Prince | 272/78 |
| 4,572,504 | 2/1986 | DiBartolo | 272/76 |
| 4,583,730 | 4/1986 | Gecht et al. | 272/76 |

FOREIGN PATENT DOCUMENTS

| | | | |
|---|---|---|---|
| 2547190 | 4/1977 | Fed. Rep. of Germany | 272/76 |
| 2622491 | 12/1977 | Fed. Rep. of Germany | 272/76 |
| 2032289 | 5/1980 | United Kingdom | 272/76 |

OTHER PUBLICATIONS

Black Belt Magazine advertisement, p. 18, Jan. 1976.

*Primary Examiner*—S. R. Crow

[57] ABSTRACT

A device for safely securing boards for martial arts activities including a board-securing frame arrangement cooperating with a release device which enlarges the board-holding space when a board is struck to be broken, thus avoiding injury to the user which might otherwise occur from the broken board pieces. A pedestal stand is attached to the board-securing frame members so as to support same at a desired position above a floor surface.

15 Claims, 1 Drawing Sheet

DEVICE FOR SAFELY SECURING BOARDS FOR MARTIAL ARTS ACTIVITIES

BACKGROUND OF THE INVENTION

1. Field of the Invention

The present invention relates generally to a device for securely holding boards for martial arts activities in a manner which prevents injury to the user and damage to the device. More particularly, the invention relates to a device for holding martial arts boards in position for being struck by a blow from the hand or foot, such that after the blow is struck, the broken board pieces are automatically released to fall safely away from the user's hand or foot.

2. Description of Relevant Art

In the field of martial arts, a common exercise is that of board breaking. A person engaging in such exercise uses his/her hand or foot to strike a blow to a board, or a plurality of boards, so as to break same. Typically, the board(s) is held on respective sides thereof by a pair of accomplices, who hold the board(s) between them. Such manual holding of the board(s) presents a number of problems, including the possibility of injury to the holders, improper holding of the board which prevents breakage, and/or the inability of a person to practice board-breaking when alone.

To eliminate the need for such manual holding of the board(s) to be broken, there have been developed a number of devices for holding the board(s) in position to be struck. There have also been developed various types of devices which simulate board breaking.

Illustrative of prior devices which simulate board-breaking are those described below.

U.S. Pat. No. 4,171,803 issued in 1979 to Smith entitled "KARATE PRACTICE BREAKING BOARD" discloses a device for simulating a karate board to be broken, including a pair of clamp members which simulate the shape of the board. Each clamp member is provided with a handle to be held by an accomplice, and includes a support portion for holding one end of a strip of material of varying strength.

German Pat. No. 2,547,190 to Kantner discloses a device which simulates board breaking and which includes a J-shaped angle-iron frame supporting a vertical board to the short vertical portion of the J-frame, the board supporting a pad to be struck. A strut extends between the long vertical portion of the J-frame and the board, and can be adjusted to varying heights to vary the resilience of the board supporting the striking pad.

German Pat. No. 2,622,491 to Kantner discloses a device which simulates board breaking and which includes a base plate attached to a tube to be inserted into apertures in the floor of sports halls. The upper side of the base plate supports a vertical pad retainer.

United Kingdom Pat. No. 2,032,289 to Hay et al discloses a device for mounting a martial arts striker member such that when the striker member is struck with a sufficiently large force it will move. The striker member is adapted in one embodiment to move away from the user and towards the mounting means, and in another embodiment to break into two parts which pivot about the mounting means.

Illustrative of prior devices for holding actual boards to be broken are those described below.

U.S. Pat. No. 4,572,504 issued in 1986 to DiBartolo entitled "HOLDER FOR BREAKABLE KARATE BOARD" discloses a karate board holder device including upper and lower rigid frame members which are adjustable to support a number of boards either vertically or tilted at an angle. A bracket is used for mounting the holder on a wall, or the holder can be mounted on other pieces of equipment.

The "Power Fist" board holder as advertised in "Black Belt" (Jan. 1976, p. 18) comprises a martial arts boardholding device which is generally U-shaped, with upper and lower board-supporting arms and a rear arm for supporting on a wall or floor surface. The upper and lower arms are adjustable to accommodate up to six boards.

The two immediately foregoing devices are closest in purpose to the present invention inasmuch as they are adapted to support and hold actual boards to be broken. However, both such prior devices are limited with respect to the number of boards which they can support, and neither is adapted to be free-standing in a vertically-elevated position above a floor surface. Moreover, both such devices provide relatively rigid support of the boards held therein, thus increasing the possibility of injury to the user and damage to the device.

The present invention overcomes the deficiencies of the foregoing known devices by providing a martial arts board holding structure which substantially reduces the possibility of injury to the hand or foot of the user, while minimizing the possibility of damage to the device itself. Further, the board-holding device according to the invention is adjustable to hold from one to a substantial number (e.g., 15) boards to be broken. The device according to the invention also eliminates any need for attaching same to a wall surface.

SUMMARY OF THE INVENTION

The present invention provides a device for securing boards for martial arts activities, comprising means for securely holding at least one board to be broken, the holding means comprising frame portions arranged to define therebetween a board-holding space wherein the board(s) is secured. Also provided is release means, operably cooperating with the frame means, so as to move at least one of the frame portions in an outward direction relative to the board-holding space when the board(s) is struck to be broken, whereby the size of the board-holding space is enlarged.

In a preferred embodiment of the invention, the device includes a detachable pedestal supporting stand adapted to rest on a ground or floor surface so as to support the holding means at a predetermined level above the surface. Also provided are handle portions which permit manual holding of the holding means at a predetermined level, particularly when the pedestal stand is detached from the device.

The holding means according to the invention preferably comprises a pair of spaced apart elongated first frame members, and a pair of spaced apart elongated second frame members, the first and second frame members being held in spaced apart relation by an attachment frame member to which they are attached. The first and second frame members are each provided with means for adjusting same between a single board-holding position and a maximum multiple board-holding position. By adjusting the adjustment means, the holding means can be arranged to hold a single board, or any additional number of boards up to a maximum of approximately fifteen at a given time.

It is an object of the present invention to provide a martial arts board-holding device which protects against injury to a user thereof by the provision of release means for increasing the board-holding space once the board(s) has been struck to be broken.

A further object of the invention is to provide a martial arts board-holding device including its own pedestal supporting stand, thus eliminating any need for attaching the device to a support surface.

Another object of the invention is to provide a martial arts board-holding device which may be selectively manually held by a pair of oppositely-disposed accomplices, or alternatively supported by the pedestal stand.

The above and further objects, details and advantages of the invention will become apparent from the following detailed description, when read in conjunction with the accompanying drawings.

DETAILED DESCRIPTION OF PREFERRED EMBODIMENTS

Figure 1:
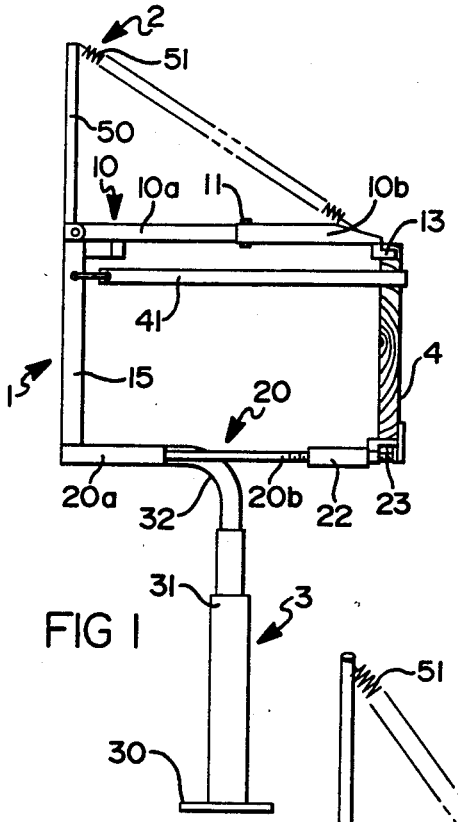
FIG. 1 is a side elevational view of a device for securing boards for martial arts activities in accordance with a preferred embodiment of the invention, as shown in a single board-holding position.

The device for safely securing boards for martial arts activities in accordance with the invention is shown in FIG. 1 as generally including a board-holding means 1, a release means 2, a supporting stand 3 and a board 4 to be broken by a blow struck by the hand of the user.

Figure 3:
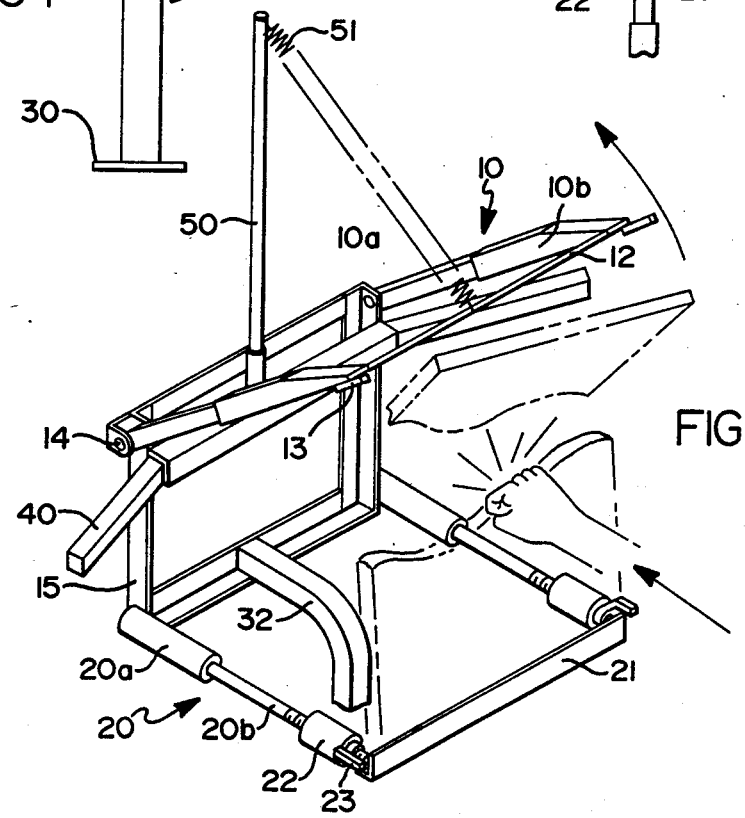
FIG. 3 is a partial perspective view of the FIG. 1 device, showing in broken line the operation of the release means when a board is struck to be broken.

As shown in FIGS. 1 and 3, the board-holding means 1 according to the invention is defined by a plurality of frame portions which together define a generally rectangular configuration of the holding means 1. Preferably, such frame portions are fabricated of a strong and rigid metal material, such as steel, so as to withstand the forces to which they are subjected when a board-breaking blow is struck by the user. The dimensions of holding means 1 are such that up to approximately fifteen 1-inch thick boards 4 can be secured therein at a given time, as will be described hereinbelow. The cross-sectional area defined by holding means is dimensioned to closely accommodate a board 4 therein, as shown in FIG. 1.

The frame portions of holding means 1 include a pair of spaced-apart first or upper frame members 10. Each of the first frame members 10 includes a pair of telescoping bars, including a rear bar 10*a* and a front bar 10*b*. The front and rear telescoping bars 10*a*, 10*b* are connected together via fastening pin members 11 (FIGS. 1 and 2) adapted to be received through an aperture provided in a rear end of front bar 10*b* and any one of a plurality of apertures provided in rear bar 10*a*.

As best shown in FIG. 3, the forward ends of front bars 10*a* are tapered so as to minimize injury to the user when a blow is struck as described hereinbelow. At the forward most ends thereof, the front bars 10*a* are rigidly connected to a flat and elongated first cross-piece 12 adapted to rest on top of a rearmost (or a single) board 4 to be supported. At each respective end of cross-piece 12 is provided a projection 13 adapted to abut against an upper side portion of the rearmost (or single) supported board 4.

The rear ends of each of the rear bars 10*a* are pivotably connected at 14 to respective upper portions of a rectangular attachment frame portion 15. Such pivotable connection of each of the upper telescoping bars to the attachment frame portion 15 permits upward swinging of the entire first or upper frame portions 10 due to the action of the release means as will be described hereinbelow.

The holding means 1 further includes a pair of second or lower spaced-apart frame portions 20. Each of the second frame portions 20 includes a rear cylindrical member 20*a* rigidly affixed to a lower corner portion of attachment frame portion 15. Extending forwardly from each of the cylinders 20*a* is a threaded shaft 20*b*, and rigidly secured between the forward ends of the shafts 20*b* is a second elongated flat cross-piece 21.

Threadedly received on each of the threaded shafts 20*b* is an adjustment member 22 adapted to be rotate along shaft 20*b* to a desired fore-aft position thereon. Each adjustment member 22 supports an L-shaped projection 23 which is adapted to abut against a lower rear and side portion of a rearmost (or single) board 4 being supported. By threadedly rotating adjustment members 22 along shafts 20*b*, the fore-aft positions of board-supporting projections 23 are in turn adjusted.

The supporting stand 3 according to the invention, shown in FIG. 1, comprises a pedestal stand including a flat base member 30 adapted to rest on a ground or floor surface. Extending upwardly from base 30 is a substantially vertical tubular portion 31 which may be formed so as to be adjustable in height by any suitable means, if desired. A connecting piece 32, bent at substantially a right angle, extends upwardly from tubular portion 31 and is connected at its outer end with a lower central portion of attachment frame portion 15 (see FIG. 3). The outer end of connecting piece 32 is removably attached to attachment frame portion 15 by any suitable means, and preferably by means which permits ready attachment and detachment, such as a thumb screw member (not shown).

Similar to holding means 1, the pedestal stand 3 is preferably formed of a strong and rigid metal material. Such material, however, should also be relatively light in weight, so as to facilitate transporting of the device from place to place. In this respect, it is to be understood that the entire device, including pedestal stand 3, is portable.

An alternative support structure for holding means 1 is provided in the form of a handle member attached adjacent an upper portion of attachment frame portion 15, and including outwardly extending handles 40 (FIG. 3). When the pedestal stand 3 is selectively detached from holding means 1 (or even with pedestal stand 3 attached), the handles 40 provide a gripping means for supporting the holding means 1 at a desired distance above a floor surface. To this end, two accomplices positioned at respective sides of holding means 1 can grip the respective handles 40 to support the device when desired.

Also attached to the attachment frame portion 15 is an elastic strap 41 (FIGS. 1 and 2), which provides an optional board securing means as will be described hereinbelow. The strap 41 has the ends thereof respectively removably attached adjacent upper ends of the opposite vertical portions of attachment frame portion 15.

Figure 2:
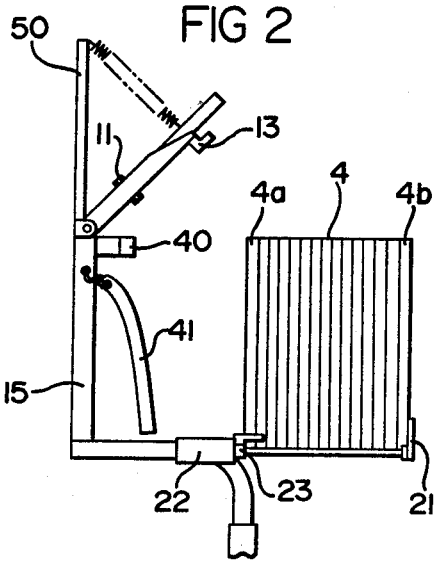
FIG. 2 is a partially cut-away side elevational view of the device of FIG. 1, shown in a multiple board-holding position.

The release means 2 according to the invention will now be described. Release means 2 comprises an elongated rod 50 connected at one end thereof to a central upper portion of attachment frame portion 15, as shown in FIG. 3, so as to define substantially a right angle relative to the first frame portions 10 in their normal horizontal positions (FIG. 1). Extending from the upper end of rod 50 to a central portion of cross-piece 12 is a coil spring 51. It will be understood that the length of rod 50 and the tension and length of coil spring 51 is selected so as to permit first frame members 10 to remain in their normal horizontal positions when supporting a board, and to be swung upwardly as shown in FIGS. 2 and 3 when the board(s) are struck to be broken.

In use, the upper frame members 10 and lower frame members 20 are first adjusted to accommodate the number of boards to be supported. When only a single board is to be supported as shown in FIG. 1, the adjustment members 22 are rotated along shaft **20*b* to a forward position in which the projections 23 are disposed proximal to cross-piece 21. In addition, the upper telescoping bars 10*a*, 10*b* are adjusted by placing the fastening means 11 through the aperture in front bar 10*b* and a forward most aperture in rear bar 10*a*. The board 4 is then positioned in the holding means such that the lower end thereof is supported between the rear side of cross-piece 21 and the projections 23, while the upper end thereof has the upper cross-piece 12 resting thereon and the projections 13 abutting against upper side surfaces thereof. If desired, strap 41 is stretched around the upper portion of board 4 and hooked by suitable hook members into apertures provided in attachment frame portion 15, as shown in FIG. 1**.

With board 4 thus secured within holding means 1, the user than strikes the board with a blow by the hand as shown in FIG. 3. As soon as the board is struck to be broken, release means 2 will function to swing upper frame members 10 with attached cross-piece 12 upwardly about pivots 14. This upward swinging movement of the upper frame members will protect the user's hand and/or wrist from injury both during the striking movement of his/her hand, and during the subsequent retraction movement of his/her hand. In this respect it will be understood that the upward movement of the upper frame members enlarges the board-holding space defined within the frame portions sufficiently to permit broken board pieces to fall away to the sides or back. As such, injury to the user's hand from the broken board pieces, which might otherwise occur if the broken board pieces were to remain confined within the board-holding space, is effectively avoided. This applies both during entry of the hand into such space, and removal of the hand therefrom.

In order to adjust the holding means 1 to accommodate a plurality of boards, the user has merely to adjust the telescoping bars (via the adjustment apertures and the fastening means 11) to desired lengths, and to rotate the adjustment members 22 along shafts **20*b* to the desired fore-aft positions. In this respect, it will be understood that the adjustment of the telescoping bars 10*a*, 10*b* and the positioning of adjustment members 22 are effected such that the projections 13 and 23** are disposed substantially in the same vertical plane.

FIG. 2 shows the maximum multiple board-supporting position of the bars **10*a*, 10*b* adjustment members 22**, wherein fifteen boards are simultaneously secured within the holding means, for example. In this respect, it will be understood that the present invention affords great flexibility with respect to the number of boards which may be secured at a given time, thus offering the user the opportunity to test his board-breaking skills over a wide range of ability.

Although FIGS. 1–3 each depict the device according to the invention in a position for striking board-breaking blows by the hand, it will be understood that the device is readily adaptable to foot board-breaking exercises. To this end, the user has merely to lay the device on its side, with the rectangular attachment frame portion 15 resting on the floor or ground surface, so that the board(s) are supported horizontally (rather than vertically as shown in the figures). With the device thus positioned on its side, the release means will extend to the side so as to still remain fully operable to swing the frame members 10 outwardly upon breaking of the board(s) 4. In this manner, the user's foot is protected from injury both as it comes down upon the board(s), and as it is removed.

Although there have been described what are at present considered to be the preferred embodiments of the invention, it will be understood that various changes and modifications may be made therein without departing from the scope or spirit of the invention. The scope of the invention is therefore not limited to the preceding description, and is instead indicated by the appended claims.

I claim:

1. A device for securing boards for martial arts activities, comprising:

means for securely holding at least one board to be broken;

said holding means comprising frame portions arranged to define therebetween a board-holding space wherein said board is secured;

release means operably cooperating with said frame portions so as to move at least one of said frame portions in an outward direction relative to said board-holding space when said board is struck to be broken, whereby the size of said board-holding space is enlarged, said device is portable; and a supporting stand adapted to rest on a ground or floor surface so as to support said holding means at a predetermined level above said surface, said frame portions comprise an adjustable first frame portion and an adjustable second frame portion, said first and second frame portions being connected at rear ends thereof with an attachment frame portion which supports said first and second frame portions in spaced relation to each other so as to define said board holding space, whereby the legends of said first and second frame portions may be adjusted to accommodate various numbers of boards.

2. A device for securing boards according to claim 1, wherein:

said release means is operably connected with said first frame portion so as to move said first frame portion in an outward direction away from said second frame portion when said board is struck to be broken; and said supporting stand is attached to said attachment frame portion adjacent said rear end of said second frame portion.

3. A device for securing boards according to claim 2, wherein:

said first frame portion includes a first pair of spaced apart elongated frame members extending substantially parallel to each other;

said second frame portion includes a second pair of spaced apart elongated frame members extending substantially parallel to each other and substantially parallel to said first pair of frame members; and said frame members are adapted to support said board(s) adjacent forward ends thereof.

4. A device for securing boards according to claim 3, wherein:

said first frame members each comprises a pair of telescoping bars operably cooperating with locking means for locking said telescoping bars together at selective relative positions to permit adjustment of the lengths of said first frame members; and each said pair of telescoping bars includes a rear bar having a rear end thereof pivotably connected with said attachment frame portion and a front bar having a forward end thereof supporting a board holding member.

5. A device for securing boards according to claim 4, wherein:

said second frame members each comprises a threaded shaft portion extending rearwardly from said forward end thereof;

each said threaded shaft portion has threadedly received thereon an internally-threaded adjustment member provided with a board-supporting projection; and said adjustment members are adapted to be respectively threadedly rotated along said threaded shaft portions so as to permit selective adjustment of the position of said board-supporting projections along the lengths of said threaded shaft portions.

6. A device for securing boards according to claim 5, wherein:

said board-holding member supported by said forward ends of said front bars of said first frame members comprises a first cross-piece extending between said forward ends of said front bars and rigidly affixed thereto; and said first cross-piece is adjustable between a forward most position thereof and a rearmost position thereof by selective adjustment of the position of said front bars relative to said rear bars via said locking means.

7. A device for securing boards according to claim 6, wherein:

said threaded shaft portions of said second frame members support a second cross-piece between forward ends thereof, said second cross-piece being rigidly affixed to said forward ends of said threaded shaft portions.

8. A device for securing boards according to claim 7, wherein:

said first and second frame members are adjustable between a single board-holding position and a maximum multiple board holding position;

said adjustment members are threadedly rotatable along said threaded shafts such that said board-supporting projections are disposed proximal to said second cross-piece in said single board-holding position, and distal to said second cross-piece in said maximum multiple board holding position; and said board(s) are supported by said second frame members between said second cross-piece and said adjusted board-supporting projections.

9. A device for securing boards according to claim 7, wherein:

said first cross-piece is disposed in said forward most position thereof in said single board-holding position, and in said rearmost position thereof in said maximum multiple board holding position; and said first cross-piece is provided with a projecting piece at each end thereof, said projecting pieces being adapted to abut against respective side portions of a rearmost one of said board(s).

10. A device for securing boards according to claim 8, wherein:

said device further comprises an elastic strap member secured at its ends to said attachment frame portion so as to define a loop; and said strap member is adapted to be stretched around said board(s) along portions thereof proximal to said first frame members, such that said board(s) are supported by said first frame members between said first cross-piece and said strap.

11. A device for securing boards according to claim 6, wherein:

said release means comprises:

an elongated rod affixed at one end thereof to said attachment frame portion so as to extend outwardly therefrom and to define substantially a right angle with said first frame members;

a coil spring extending between the other end of said rod and said first cross-piece; and said release means being adapted to swing said first frame members outwardly relative to said second frame members when said board(s) are struck to be broken.

12. A device for securing boards according to claim 3, wherein:

said supporting stand comprises a pedestal stand including a flat base portion adapted to rest on said ground or floor surface; and an upper end of said pedestal stand is attached to said attachment frame portion adjacent said rear end of said second frame portion.

13. A device for securing boards according to claim 12, wherein:

said upper end of said pedestal stand is removably attached to said attachment frame portion;

a pair of handle portions are provided so as to extend outwardly from respective sides of said attachment frame portion; and said handle portions are adapted to be manually held so as to support said holding means when said pedestal stand is detached from said device.

14. A device for securing boards according to claim 8, wherein:

said device is adapted to selectively support fifteen of said boards in said maximum multiple board holding position.

15. A device for securing boards for martial arts activities, comprising:

means for securely holding at least one board to be broken;

said holding means being adjustable between a single board holding position and a maximum multiple board-holding position;

said holding means comprising frame portions arranged to define therebetween a board-holding space wherein said board(s) are secured; and a supporting stand adapted to rest on a ground or floor surface so as to support said holding means at a predetermined level above said surface;

said device is portable;

an upper end of said supporting stand is removably attached to one of said frame portions of said holding means;

a multiplicity of handle portions is attached to said holding means so as to extend from respective side portions thereof, said handle portions being adapted to be manually held so as to support said holding means when said supporting stand is selectively detached from said device;

release means operably cooperating with said frame portion so as to move at least one of said frame portions in an outward direction relative to said board-holding space when said board is struck to be broken, whereby the size of said board-holding space is enlarged;

said frame portions comprise a first frame portion and a second frame portion, said first and second frame portions being connected at rear ends thereof with an attachment frame portion which supports said first and second frame portions in spaced relation to each other so as to define said board-holding space; and means are provided for adjusting said first and second frame members between a single board-holding position and a maximum multiple board holding position.

* * * * *